US006505819B1

(12) United States Patent
Damon et al.

(10) Patent No.: US 6,505,819 B1
(45) Date of Patent: Jan. 14, 2003

(54) BARRIER FOR THE BOTTOM OF FENCES

(76) Inventors: Gary L. Damon, 2150 N. Raymond Rd., Dewar, IA (US) 50623; Jerry L. O'Donnell, 3906 Onawa Dr., Waterloo, IA (US) 50701

( * ) Notice: Subject to any disclaimer, the term of this patent is extended or adjusted under 35 U.S.C. 154(b) by 0 days.

(21) Appl. No.: 09/495,144

(22) Filed: Jan. 31, 2000

Related U.S. Application Data

(63) Continuation-in-part of application No. 08/942,750, filed on Oct. 2, 1997.

(51) Int. Cl.[7] ..... E04H 17/00
(52) U.S. Cl. ..... 256/1; 256/32
(58) Field of Search ..... 256/1, 19, 32, 256/33; 47/33, 25, 84

(56) References Cited

U.S. PATENT DOCUMENTS

| | | | | | |
|---|---|---|---|---|---|
| 2,826,393 | A | | 3/1958 | Miller | 256/19 |
| 3,384,351 | A | * | 5/1968 | Turner, Jr. | 256/32 |
| 3,393,897 | A | * | 7/1968 | Wright | 256/32 |
| 3,515,373 | A | | 6/1970 | Abbe | 256/32 |
| 3,619,944 | A | | 11/1971 | Matvey | 47/33 |
| 3,704,004 | A | | 11/1972 | Carter, Jr. | 256/1 |
| 3,713,624 | A | | 1/1973 | Niemann | 256/32 |
| 3,806,096 | A | | 4/1974 | Eccleston et al. | 256/32 |
| 3,822,864 | A | * | 7/1974 | Keys | 256/32 |
| 3,991,980 | A | | 11/1976 | Blackburn | 256/45 |
| 4,349,989 | A | | 9/1982 | Snider, Jr. | 47/33 |
| 4,497,472 | A | | 2/1985 | Johnson | 256/32 |
| 4,903,947 | A | | 2/1990 | Groves | 256/32 |
| 4,907,783 | A | | 3/1990 | Fisk et al. | 256/32 |
| 4,964,619 | A | | 10/1990 | Glidden, Jr. | 256/32 |
| 5,039,065 | A | | 8/1991 | Denton | 256/1 |
| 5,178,369 | A | | 1/1993 | Syx | 256/32 |
| 5,285,594 | A | | 2/1994 | Penny | 47/9 |
| 5,328,156 | A | | 7/1994 | Hoke | 256/32 |
| 5,522,176 | A | | 6/1996 | Suttle | 47/25 |
| 5,586,753 | A | * | 12/1996 | Michiaels | 256/32 |
| 5,660,374 | A | * | 8/1997 | Dayberry | 256/1 |
| 6,070,859 | A | * | 6/2000 | Damon et al. | 256/1 |

FOREIGN PATENT DOCUMENTS

| | | | | |
|---|---|---|---|---|
| GB | 2207845 | * | 7/1988 | 47/33 |

* cited by examiner

*Primary Examiner*—Lynne H. Browne
*Assistant Examiner*—David E. Bochna
(74) *Attorney, Agent, or Firm*—McKee, Voorhees & Sease, P.L.C.

(57) ABSTRACT

An improved blocking member and vegetation barrier for the bottom of fences. A ground covering member has first and second opposite ends and opposite rolled under edges, and it somewhat rigid but somewhat flexible. The ground covering member can be placed directly on the ground even if the ground undulates relative to the fence bottom, and can be kept in that position once the riser is secured to the fence. The ground covering member can be resilient and create reactionary force if it is pressed against the ground. This can further assist in maintaining the blocking member and vegetation barrier in a fixed position relative the ground and the fence. The device can be made in lengths that can be interconnected with one another and/or installed between fence posts.

15 Claims, 18 Drawing Sheets

BARRIER FOR THE BOTTOM OF FENCES

CROSS-REFERENCE TO RELATED APPLICATION

This application is a continuation-in-part of and claims the benefit of U.S. application Ser. No. 08/942,750 filed Oct. 2, 1997.

BACKGROUND OF THE INVENTION

1. Field of the Invention

The present invention relates to fences, particularly those used for residential purposes, and in particular, to devices and methods to deter vegetation growth under the fences.

2. Problems in the Art

Property owners many times erect fences to delineate property boundaries, to obtain privacy, or to restrict either access to or egress out of the property at that location. The most popular types of fences, particular for residential properties, are chain link fences and wooden board fences.

Both types generally include fence posts secured in the ground at regularly spaced intervals. The fence itself is usually built between posts and above the ground. It is usually intended and desired that the bottom of the fence extend to the ground or as close to the ground as possible to provide a barrier to entry or exit of even smaller animals or pets.

Several problems face the fence owner. First, when installing the fence there are limitations as to how close to the ground the fence can be placed, especially if there are changes in the contour of the ground along the fence. Chain length fencing has some ability to follow such contours, but if the fence is to be held tight between posts, such flexibility is limited. Wooden fences can be customized as to each board's length, and thus theoretically could adapt to any contour. However, realistically, most fences come pre-manufactured with boards of the same length. It is usually desired to have the top of the fence relatively uniform, and therefore, varying the height of several boards to meet a depression or raised portion of the ground is not desirable.

Secondly, trimming grass and weeds and other vegetation around the fence bottom can be difficult and time consuming. While labor-reducing devices such as string trimmers are in wide use, it is still time consuming to trim along fences, and most fences tend to wear away the string of such trimmers at a substantial rate.

Thus there is a need for a solution to the problems of building a fence only to have gaps between portions of the fence bottom and the ground, especially where there are undulations or changes in the contour of the ground along the fence, especially between fence posts, and of building a fence and facing the task of keeping it free from vegetation or having an unsightly fence row.

Somewhat surprisingly, there are a significant number of issued patents that address the issue of providing a barrier to vegetation along a fence bottom. Examples can be found at:

| PATENT NUMBER | ISSUE DATE | PATENTEE |
|---|---|---|
| 2,826,393 | Mar. 11, 1958 | MILLER |
| 3,515,373 | Jun. 2, 1970 | ABBE |
| 3,713,624 | Jan. 30, 1973 | NIEMANN |
| 3,806,096 | Apr. 23, 1974 | ECCLESTON ET AL. |

-continued

| PATENT NUMBER | ISSUE DATE | PATENTEE |
|---|---|---|
| 4,349,989 | Sep. 21, 1982 | SNIDER, JR. |
| 4,497,472 | Feb. 5, 1985 | JOHNSON |
| 5,178,369 | Jan. 12, 1993 | SYX |
| 4,907,783 | Mar. 13, 1990 | FISK ET AL |
| 4,964,619 | Oct. 23, 1990 | GLIDDEN, JR. |
| 5,285,594 | Feb. 15, 1994 | PENNY |
| 5,328,156 | Jul. 12, 1994 | HOKE |

However, none of these patents address satisfactorily the first problem discussed above; namely, how to block gaps that exist or form between the bottom of a fence and the ground. Patents such as Abbe are buried in the ground, and therefore follow the ground contour, but have no upwardly extending portion. Therefore, big gaps would remain. Others are too structurally rigid to bend, once installed, or do not have anyway to bend to follow a ground contour.

Moreover, many of the patents are complex, expensive to make or install, or otherwise have deficiencies that could allow improvement. A subtle deficiency in some prior art attempts is that part of the installation would have to occur on the adjoining property owner's land, which sometimes is not possible or will not be permitted.

Therefore, despite a seemingly substantial number of attempts at solving the problems with the bottoms of fences, a real need in the art has been identified. It is therefore a principle object of the present invention to overcome the problems and deficiencies in the art.

Still further objects of the present invention are to provide an improved gap blocker and vegetation barrier for fence bottoms which:

1. can be conformed to a wide variety of ground contours and fence bottoms while maintaining both functions of blocking any gaps and deterring vegetation growth.
2. is strong and durable, even when stepped by persons or animals and run over by mowers.
3. is easy to install.
4. is economical.
5. is flexibly adaptable regarding type of fence, type of barrier desired, coverage of barrier desired, size and length of fencing, number of corners of fencing, and other characteristics of fences, ground and environment.
6. can be retrofitted to existing fences of many different types or installed with the installation of a new fence.
7. is effective to block gaps and deter vegetation growth at the bottom of fences.
8. is aesthetically pleasing.

These and other objects, features, and advantages of the present invention will become more apparent with reference to the accompanying specification and claims.

SUMMARY OF THE INVENTION

The present invention is a gap blocker and vegetation barrier for the space between a fence bottom and the ground.

It comprises an elongated member having opposite ends and a width terminating in opposite edges. The opposite edges comprise rolled under portions. The elongated member is made of a somewhat rigid but somewhat flexible material. One placed on the ground, the rolled under edges tend to seal against the ground and assist in pushing back up against any force on top of the elongated member.

The flexibility and shape of the elongated member allows a plurality of elongated members to be interfit longitudinally.

In one embodiment of the invention, a pre-formed fence post hole exists near one end of the elongated member and the opposite end of the elongated member is squared off. The opposite end can be cut off to adjust the longitudinal length of the elongated member so that it can be fit snuggly between fence posts.

Another optional aspect of the invention is utilization of an insert can be placed either underneath the elongated member or above the elongated member to arch the elongated member at a location along its length to fill up gaps of space that might occur between the bottom of a fence and the elongated member when placed on the ground.

A still further optional aspect or embodiment of the invention is a vertical riser secured along all or part of the longitudinal length of the elongated member. The vertical riser can be used to secure the elongated member to a solid fence or a chain link fence. A still further embodiment, the vertical member can be scored along its intersection with the elongated member to allow it to fold down for storage or shipping and yet be folded up for use. The scoring could also be used to assist in cutting the vertical riser off if needed or desired.

DETAILED DESCRIPTION OF THE PREFERRED EMBODIMENT

Figure 1:
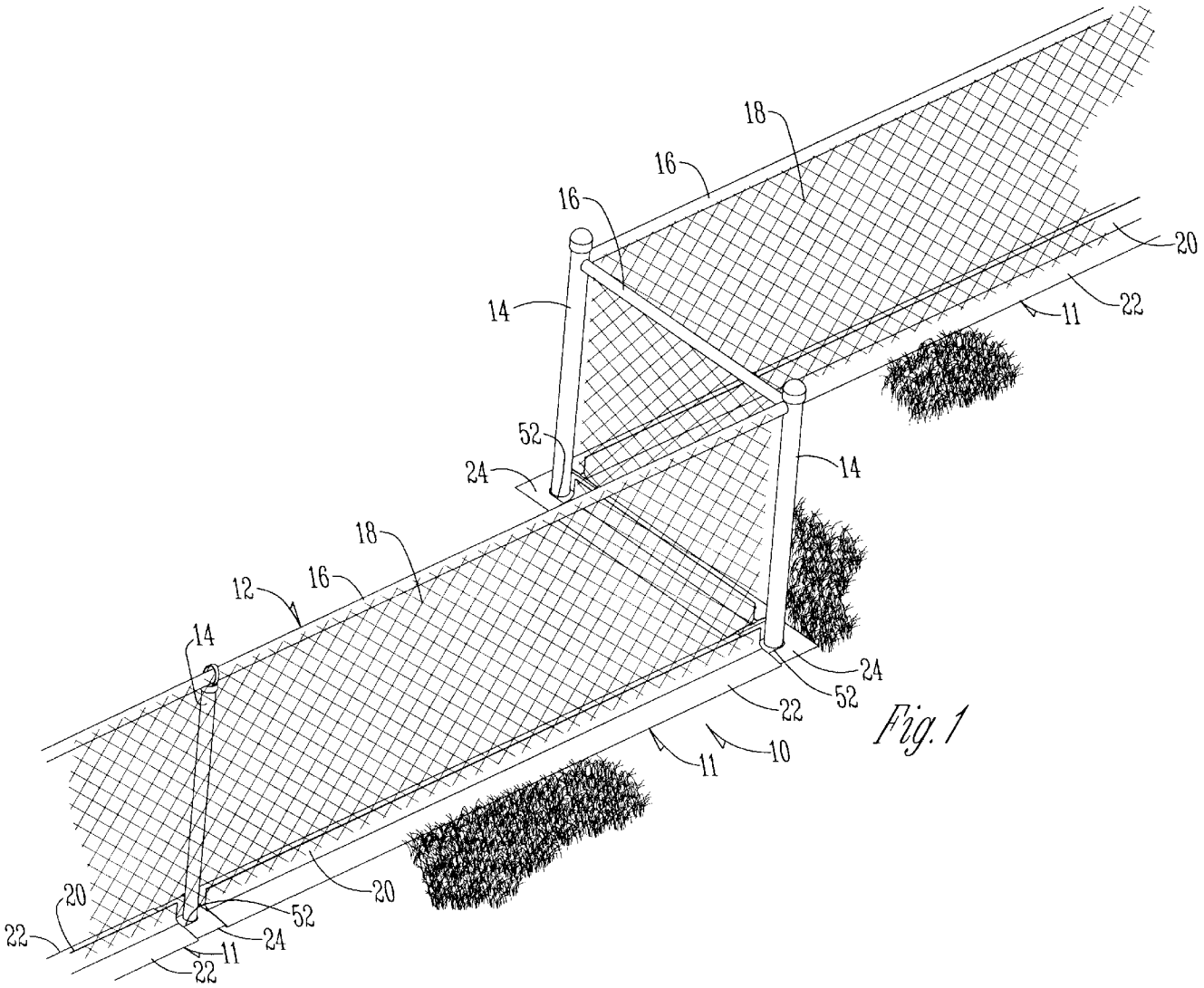
FIG. 1 is a perspective view of a multi-section apparatus according to the present invention installed with respect to a chain link fence.

To assist in a better understanding of the invention, one embodiment the invention can take will now be described in detail. Frequent reference will be taken to the drawings. Reference numbers will be used to indicate certain parts or locations in the drawings. The same reference numerals will be used to indicate the same parts and locations throughout all the drawings unless otherwise stated.

FIG. 1 shows an apparatus according to the present invention which will hereafter be referred to generally as barrier 10 installed in position relative to a chain link fence 12. Pence 12 includes fence posts 14 secured into the ground at spaced apart positions, top rails 16 secured between posts 14, and the chain link fabric or web 18 strung between poles 14. Barrier 10 is positioned under the bottom of web 18 of fence 12 along its entire length. It is to be understood that barrier 10 will be discussed mainly in the context of use with a chain link fences, such as are well known well, but it can be used with other types of fences. Some examples will be discussed later.

Barrier 10 is produced in elongated sections 11, ideally of lengths that span just about the distance between posts 14. For example, if the standard distance between posts 14 was ten feet, each barrier section 11 would be made slightly under ten feet long so that it could be inserted between the posts 14 with a little space left. However, obviously, sections 11 could be made to any length and could have variable length.

Each section 11 of barrier 10 has a riser 20 and ground cover portion 22. As seen in FIG. 1, when installed risers 20 extend generally vertically along one side of web 8 and cover portions 22 extend generally horizontally over the ground below or near the bottom of web 18. Spacers 24 are insertable between sections 11 of barrier 10 to cover the ground between those sections, particularly around fence posts 14.

As can be seen in FIG. 1, barrier 10 not only covers and deters vegetation growth under fence 12 and for a distance to the side of fence 12, but also blocks any gaps between the bottom of web 18 and the ground. It also gives the appearance of a foundation or base which is aesthetically appeasing. It is to be understood that barrier 10 could be made of different colors, including to match the color of the fence or to match the color of vegetation, such a green for grass, to assist in the aesthetic appearance.

Figure 2:
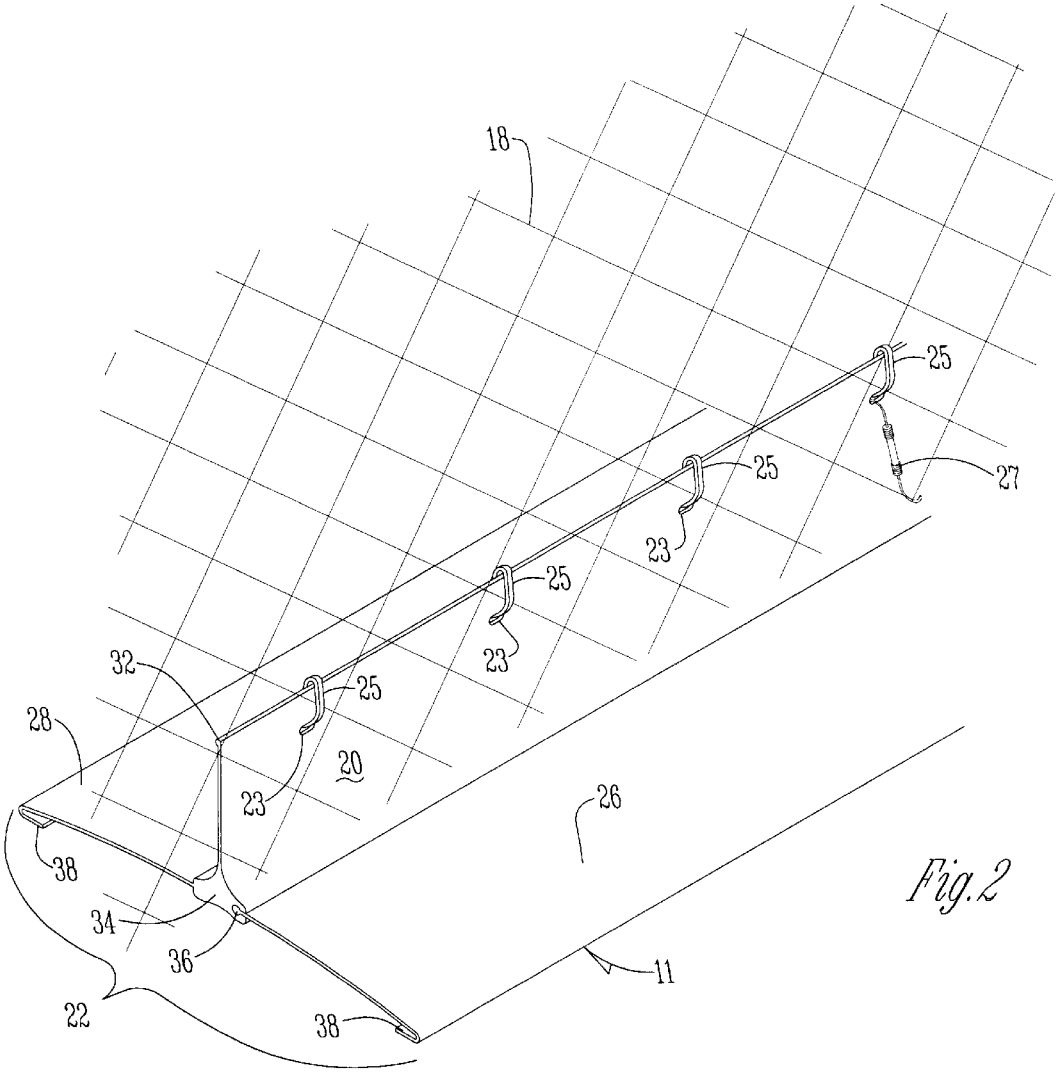
FIG. 2 is an enlarged perspective view of a single section of the apparatus of FIG. 1 relative to a chain link fence.

More detail of the structure and installment of barrier 10 can be seen in FIG. 2. Each riser 20 has a number of apertures 23 along its length, preferably near its top edge (e.g. elongated holes through riser 20 approximately 3/16" to ¼" in dimensions and spaced apart approximately 4" on center). Securing loops 25 are placed through apertures 23 and then around at least one strand of web 18 of fence 12. Generally, not every aperture 23 would have a securing loop 25. For example, perhaps one securing lop would be used every sixth aperture 23 (if apertures 23 were 4" apart), unless securement at other locations was needed or desired. In this embodiment, ground cover portion 22 consists of panels 26 and 28, forming a T-shape cross section for barrier 10. Panel 26 extends under web 18 to the opposite side of fence 12 from the side of riser 20, whereas panel 28 extends away from riser 20 on the same side of the fence as riser 20.

Riser 20 and panels 26 and 28 are made from 1/16" thick plastic, preferably PVC or polyethylene with UV resistance. Such materials can be made to have substantial strength but yet have some flexibility. Note that the top of riser 20 has a bead 32 for strength. The bottom of riser 20 has a thickened portion 34 for strength without unduly limiting the flexibility. Panel 28 is integral with portion 34, whereas in this embodiment, panel 26 is a separate piece that can be mounted to portion 34 by sliding bead 36 of panel 28 longitudinally into and along a channel 42 along the length of riser 20.

Note too that panels 26 and 28 are concave with respect to the ground and have turned under edges 38. This combination allows some resilient springing action of the ground cover portion of barrier 10 relative to riser 20 when barrier is either pressed down (e.g. by persons or animals stepping on or mowers moving over a panel 26 or 28) or when the barrier is intentionally pressed down and secured into place relative to fence 12. This therefore assists in blocking any gaps between the fence bottom and the ground and deterring vegetation growth by securely covering the ground without sunlight.

Securing loops 25 are conventional plastic tie downs available from a wide variety of sources. They have a toothed surface along at least a portion of their length (e.g. 4" long) that is pulled through a piece, and like a ratchet, the loop that is formed can be cinched down (reduced in size) and maintained in place, and can not move back to a larger size without destroying the tie down. These are well known. They are inexpensive, easy to install, flexible in characteristic and in the length which they can be, and are durable. Other securing loops are possible. One example would be bungy cords (FIG. 2 at 27) or other elastic devices with hooks or other end point securement means. Other types of securing members are also possible.

Figure 3:
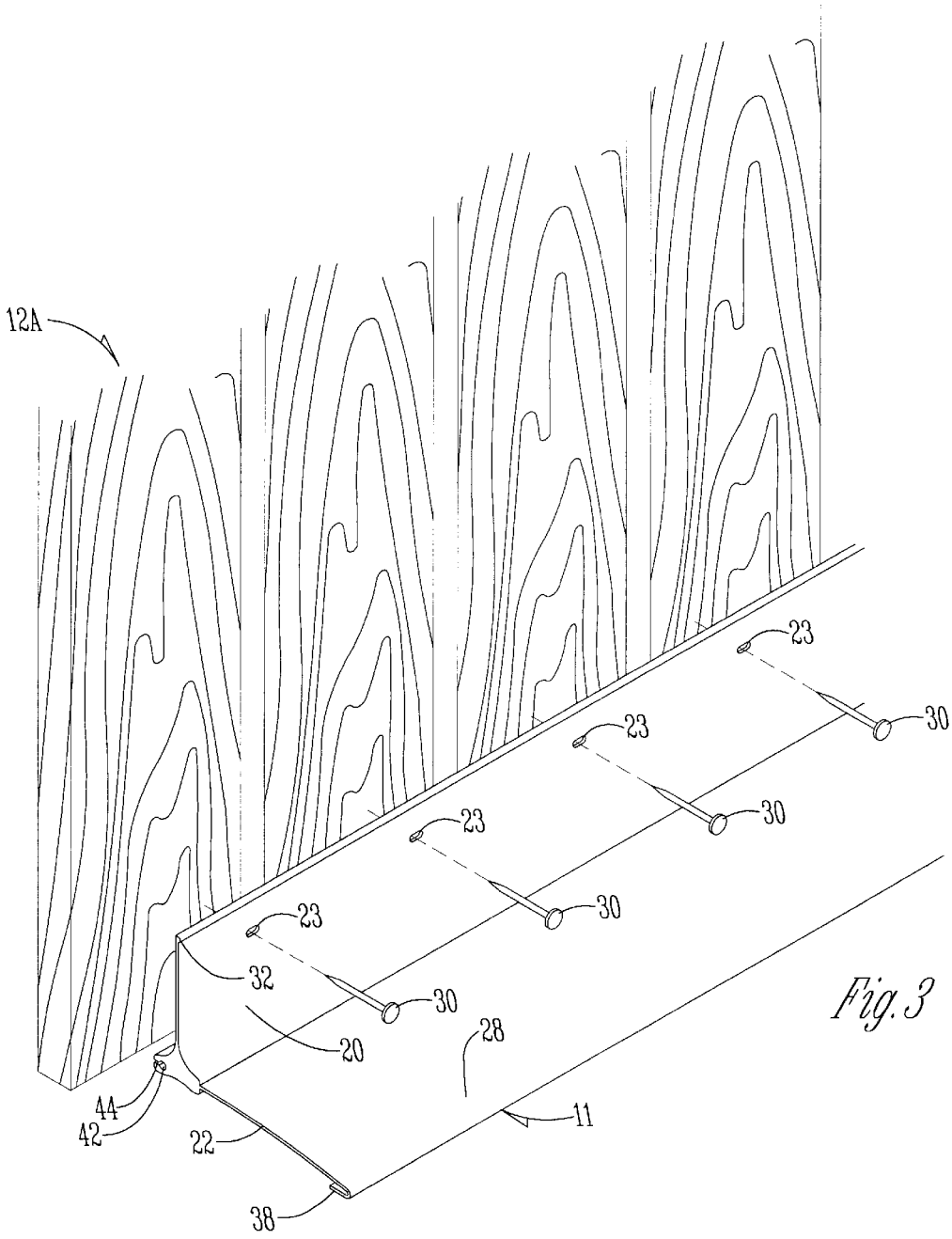
FIG. 3 is an enlarged perspective view of a section of the apparatus according to an alternative embodiment of the present invention installed to a wood fence.
Figure 4:
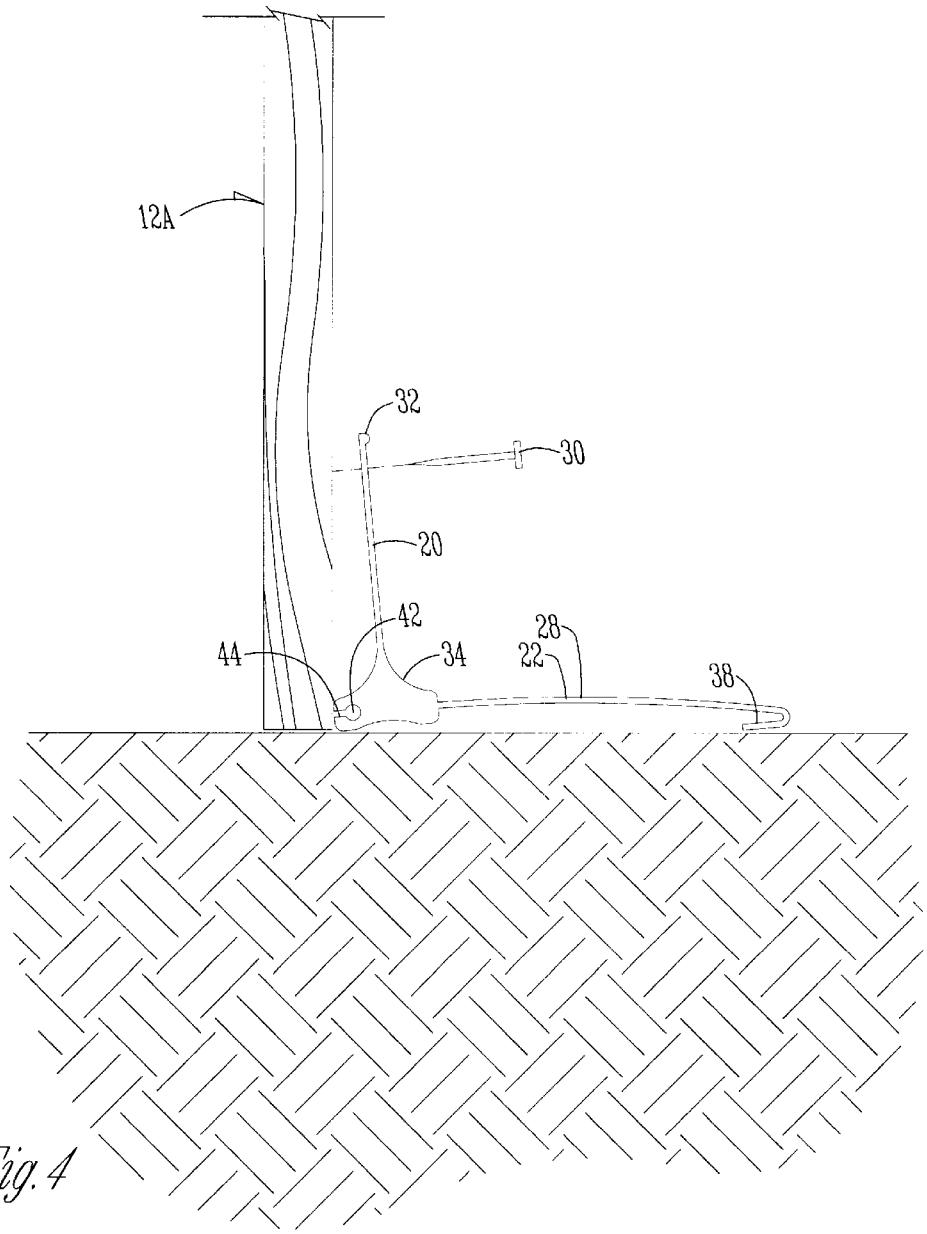
FIG. 4 is an enlarged end elevation view of FIG. 3.
Figure 4A:
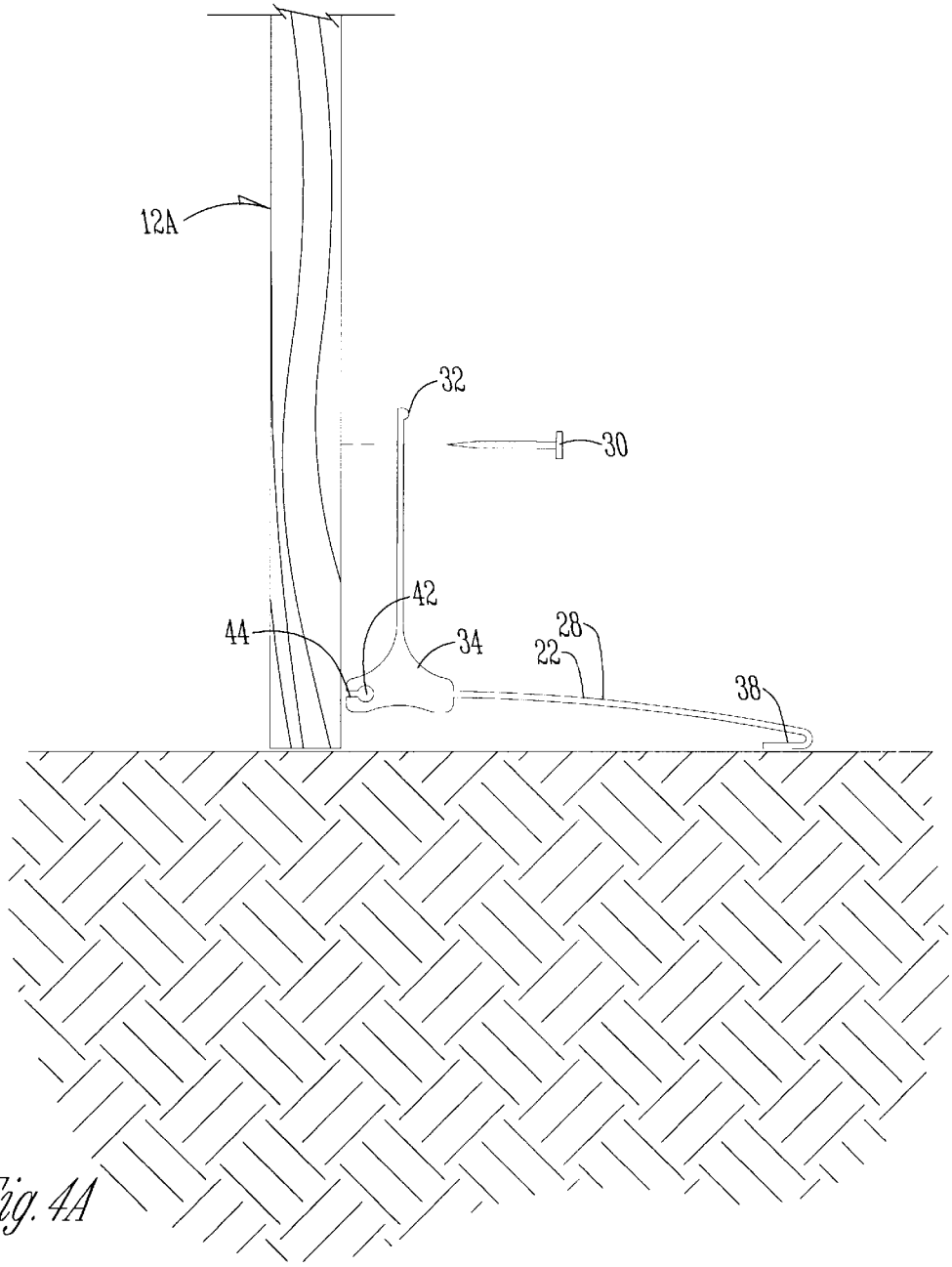
FIG. 4A is similar to FIG. 4 but shows the apparatus according to the preferred embodiment of the present invention blocking a gap between the fence bottom and the ground.

FIG. 3 illustrates how barrier 10 could be used with a wood fence 12A. It is more likely that a wood fence 12A would extend all the way to the ground or that it would not be easy to slide a panel 26 under the fence. Because the opposite side of the fence can not be seen, it may not be desired to utilize panel 26. Therefore, panel 26 can be removed (or never be installed) and, as shown in FIG. 4, riser 20 could be brought up against the wood fence 12A, and wood screws, nails, or other fasteners 30 placed through apertures 23 and into the wood. Barrier 10 would be held securely in position, including against any vertical movement. Thus, even though the fence bottom or top or both are level, for example, barrier 10 could be pushed down or pulled up along its length at various points, and secured in place on the fence. As with the prior example, the flexibility of barrier 10, along with the ability to secure riser 20, would allow barriers 10 to be flexed to follow the contour of the ground, even if the fence did not follow it. Therefore, any gaps could be taken care of by barrier 10. Compare FIGS. 4 and 4A.

Figure 5:
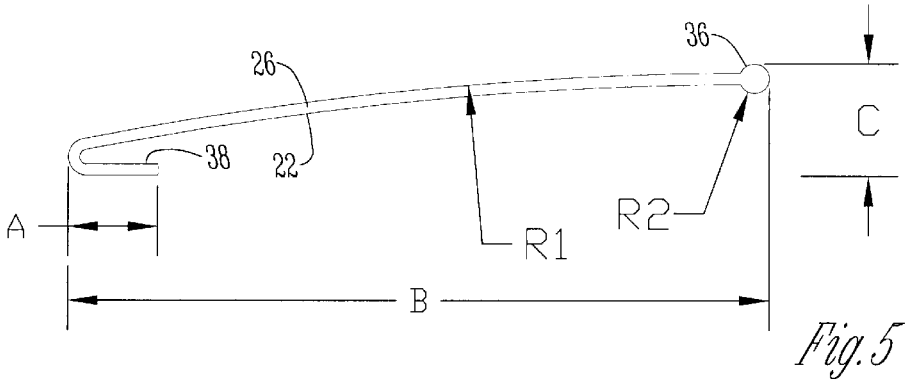
FIG. 5 is a still further enlarged, isolated end elevation view of a removable ground cover section of the apparatus of FIG. 1.

Barrier sections 11 can have the following general approximate dimensions—overall length of ten feet (but trimmable to different lengths); two to three inches tall (the height of riser 20); and six to eight inches wide (the width of both panels 26 and 28). FIG. 5 illustrates removable panel 26 in more detail. The dimensions of panel 26 are: A=0.50",; B=3.38"; C=0.64". Radius R1 is based upon a 14.4" radius; radius R2=0.120"; and radius R3=0.20". Bead 36 of panel 26 fits within a 0.125" diameter round channel 42 along portion 34 of riser 20. Slot 44 extends out form channel 42 to allow passage of panel 26 out of portion 34 and to prevent it from tilting up or down. Similar dimensional relationships exist for panel 28. Bead 32 on riser 20 is approximately ¼" in diameter and extends on one side of riser 20.

Figure 6:
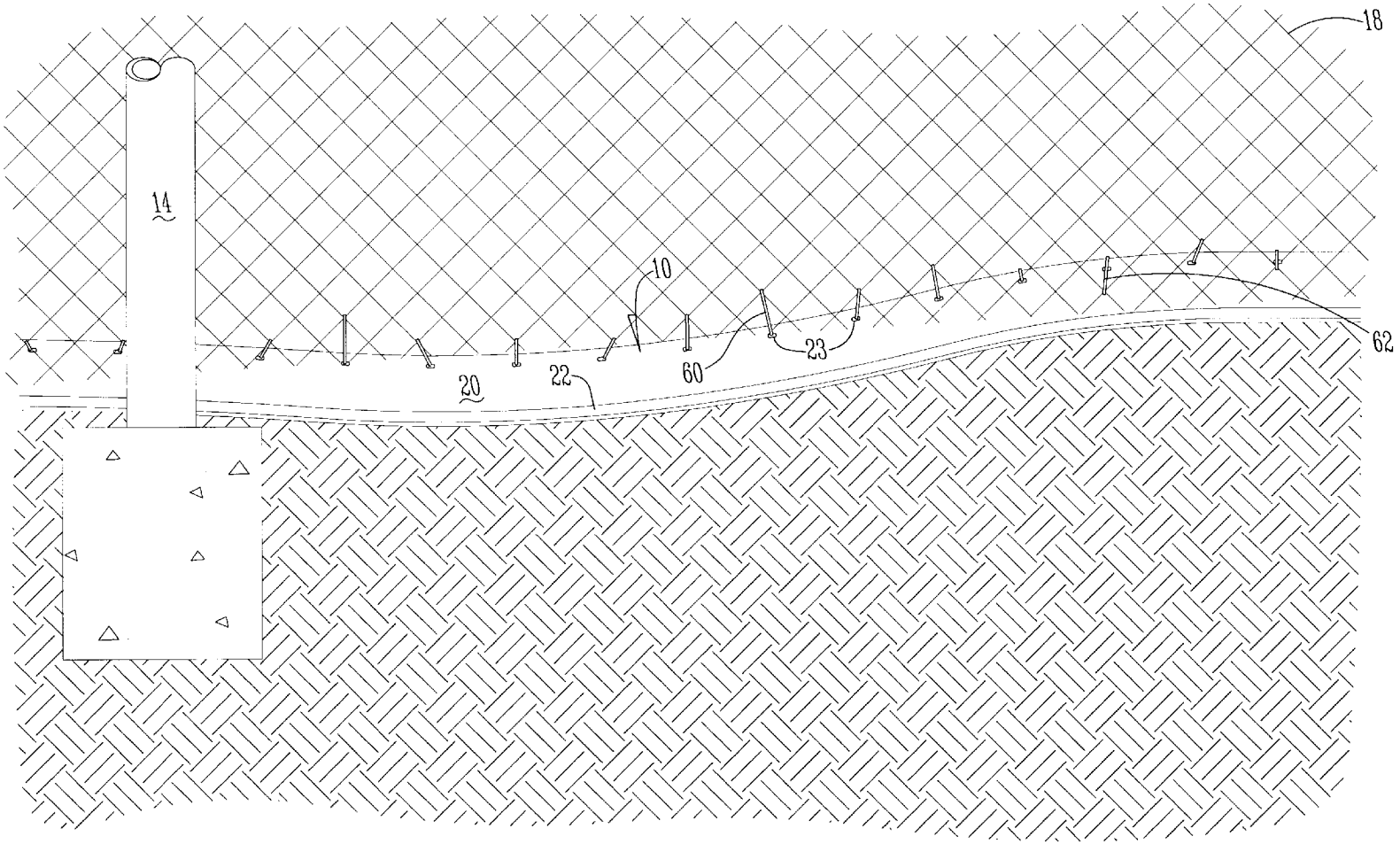
FIG. 6 is a partial sectional, front elevation view illustrating how the apparatus according to the present invention can be installed relative to a fence to follow contours of the ground.

FIG. 6 illustrates how barrier 10 can follow bends in the bottom of fence 10 or changes on contour of the ground. Securing loops 25 can be used to tie riser 20 to varying positions along fence web 18. Therefore, if barrier 10 needs to be drawn down somewhat to follow a depression in the ground or the bottom of fence 10, riser 10 is simply drawn down and tied to web 18 at a lower point than other parts of barrier 10. Plastic ties as securing loops 25 allow the installer some leeway because it may require that the plastic tie reach quite a ways up or down on web 18 to draw barrier 10 to the required position (see reference numbers 60 and 62 and compare how they and where they are tied to fence web 18. The flexibility to flex riser 20 along its length is such that it can bend several inches per linear foot of length.

Figure 7:
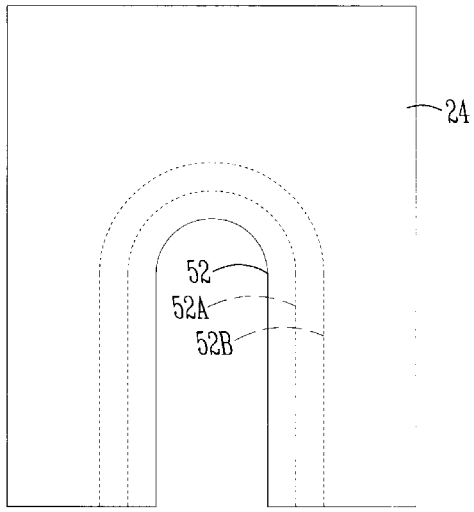
FIG. 7 is a top plan view of an interconnecting member to interconnect sections of the apparatus of FIG. 1 and to interconnect said sections and cover the ground around fence posts.
Figure 8:
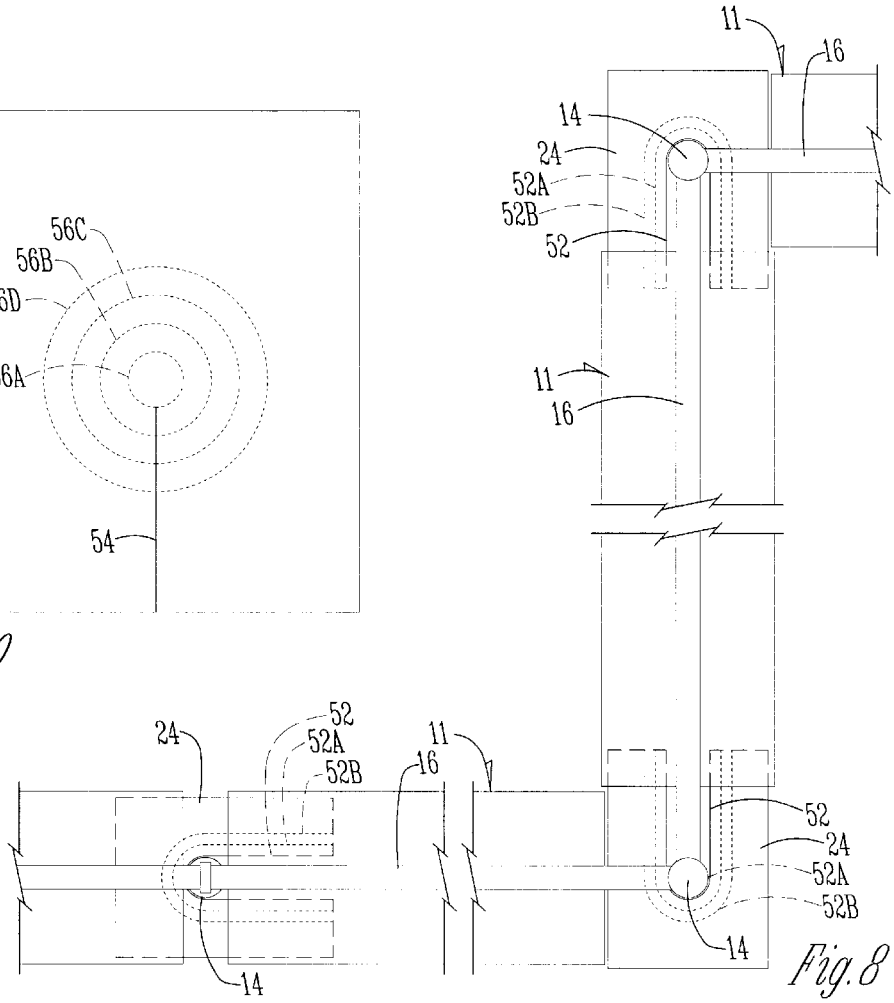
FIG. 8 is a top plan view of the interconnecting member of FIG. 7 installed relative to fence posts and corners in the fence of FIG. 1.

FIGS. 7 and 8 illustrate the spacers 24 that can cover the area around fence posts 14 or simply be used to bridge between two sections 11 of barriers 10. In one form, spacer 24 is a flat square piece of plastic having a cut out 52 sized for insertion around a round fence pole 14. Dashed line 52A indicates that a punch out or cut out line could be manufactured into the spacer to allow easy modification of spacer 24, if needed, for bigger poles.

FIG. 8 shows that spacer 24 would be inserted around pole 14 and then slid into the turned under edges 38 of panels 26 and 28 on one side of post 4. The other barrier section 11 would simply be brought near or into abutment with spacer 24 and secured into position. All areas under fence web 18 would then be at least substantially covered. Spacer 24 is sized so that its width slides into and is captured in turned down edges 38 of panels 26 and 28 of ground cover portion 22. It can be approximately 6" to 8" width and can be approximately 10" long and 1/16" thick.

Figure 9:
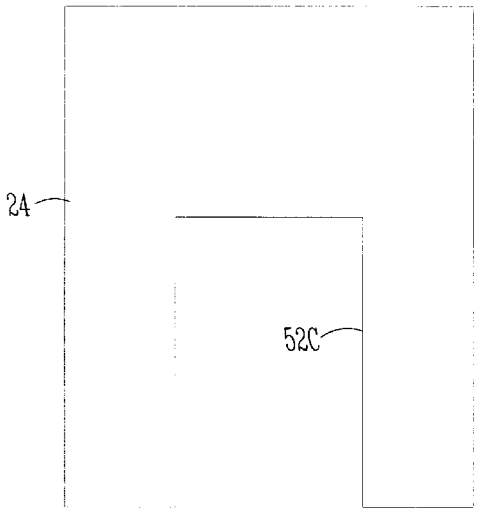
FIGS. 9 and 10 are top plan views of optional interconnecting members to that of FIG. 7.
Figure 10:
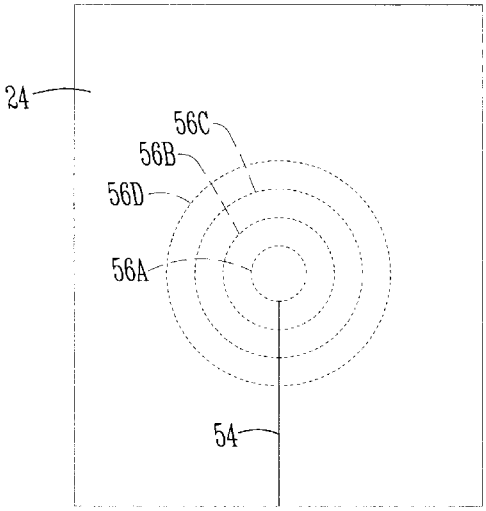

FIG. 9 illustrates that alternatively, cut out 52C could be square to accommodate square fence posts, such as some wood posts. FIG. 10 shows another embodiment of spacer 24. A square or rectangular piece could have merely a slit 54 that leads to one or more cutouts. The dashed lines indicate knock out or punch out cuts 56A, 56B, 56C, and 56D on the piece. The installer would knock out the center to the diameter needed (e.g. 1⅝", 2", 2½", 3"). Spacer 24 could be pulled around the post via the slit 54 and then installed as discussed with regard to FIG. 8.

The included preferred embodiment is given by way of example only, and not by way of limitation to the invention, which is solely described by the claims herein. Variations obvious to one skilled in the art will be included within the invention defined by the claims.

For example, barrier 10 can be made out of a number of materials. Plastics are generally preferred. Examples are PVC, polypropylene and polyethylene. The characteristics needed are set forth above including being able to flex, being able to survive all types of environmental conditions out of doors, and being able to take mowers and people and animals stepping on it. Plastic could be molded to the shape indicated herein.

As previously mentioned, the size and shape can vary. It can be manufactured by a number of methods widely known in the art. An example is injection molding.

The Figures show each section 11 to be two-piece; one piece comprising riser 20 and panel 28 integral with one another; the other piece comprising removable panel 26. Section 11 could be all one piece (riser 20 and panels 26 and 28) or riser 20 could be separate with each panel 26 and 28 removable.

Figure 12:
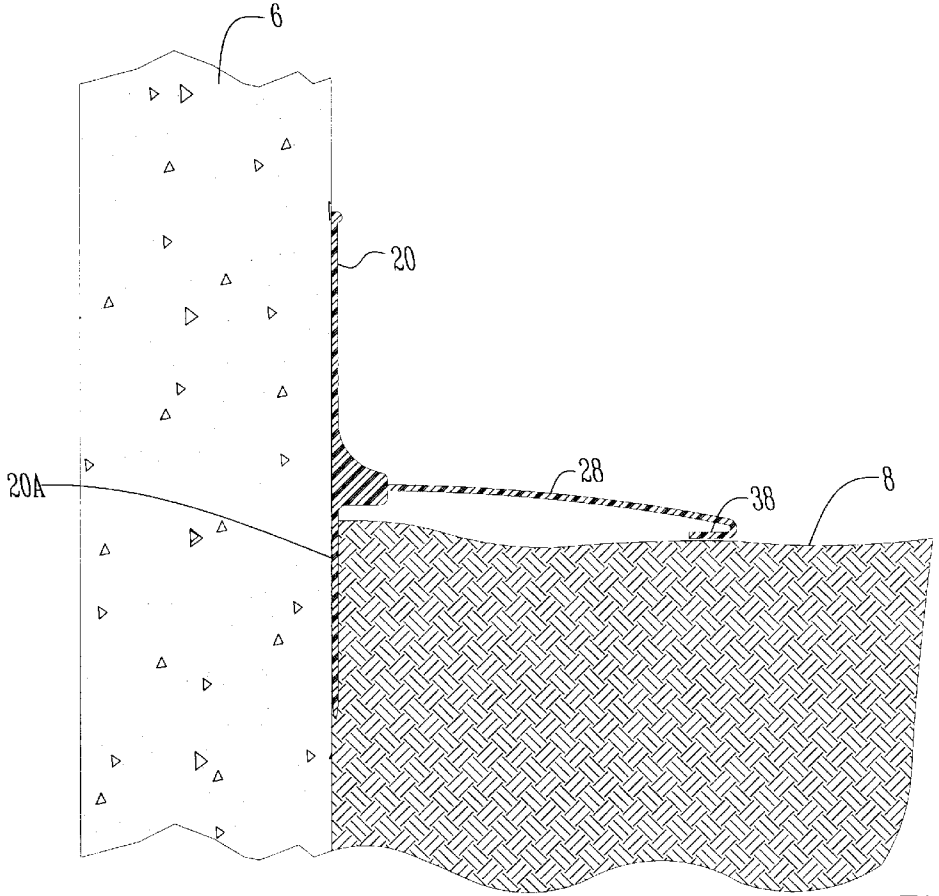
FIG. 12 is an enlarged cross sectional and elevational view of the embodiment of FIG. 11 when installed relative to the ground and a concrete foundation or wall.
Figure 11:
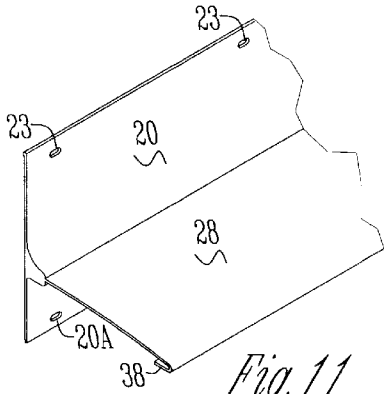
FIG. 11 is a perspective view of another embodiment according to the invention, having a portion of the vertical riser extending below the plane of the ground cover member.

FIG. 11 shows an alternative embodiment. Riser 20 and panel 28 are the same as previously described. An downward extension of riser 20 (shown at reference numeral 20A in FIG. 11) is added. As shown in FIG. 12, portion 20A can be pushed into ground 8 between vertical wall such as cement wall or foundation 6 and thus used to secure the device in place against the wall, even without nails, bolts or other attaching hardware (which could also be used). As shown in FIG. 12, the rolled under edge 38 of panel 28 provides a seal against ground 8 and also upperward pressure on panel 28 to urge maintenance of contact with ground 8.

Figure 13:
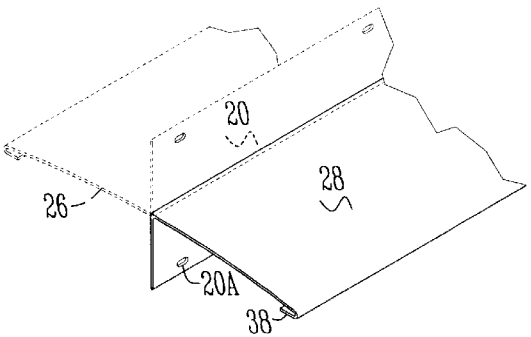
FIG. 13 shows another embodiment of the invention with a downwardly extending vertical section, and also depicting ghost lines and upwardly extending vertical section and opposite side of the ground cover member.

FIG. 13 illustrates that portion 20A could just alone be utilized with panel 28 to be placed up against a wall or fence. FIG. 13 shows in ghost lines that vertical riser 20 and panel 26, extending oppositely from panel 28, could also be utilized. It is to be understood that any of the parts illustrated could be easily removed using conventional tools such as scissors, tin snips, utility knives, etc.

Figure 14:
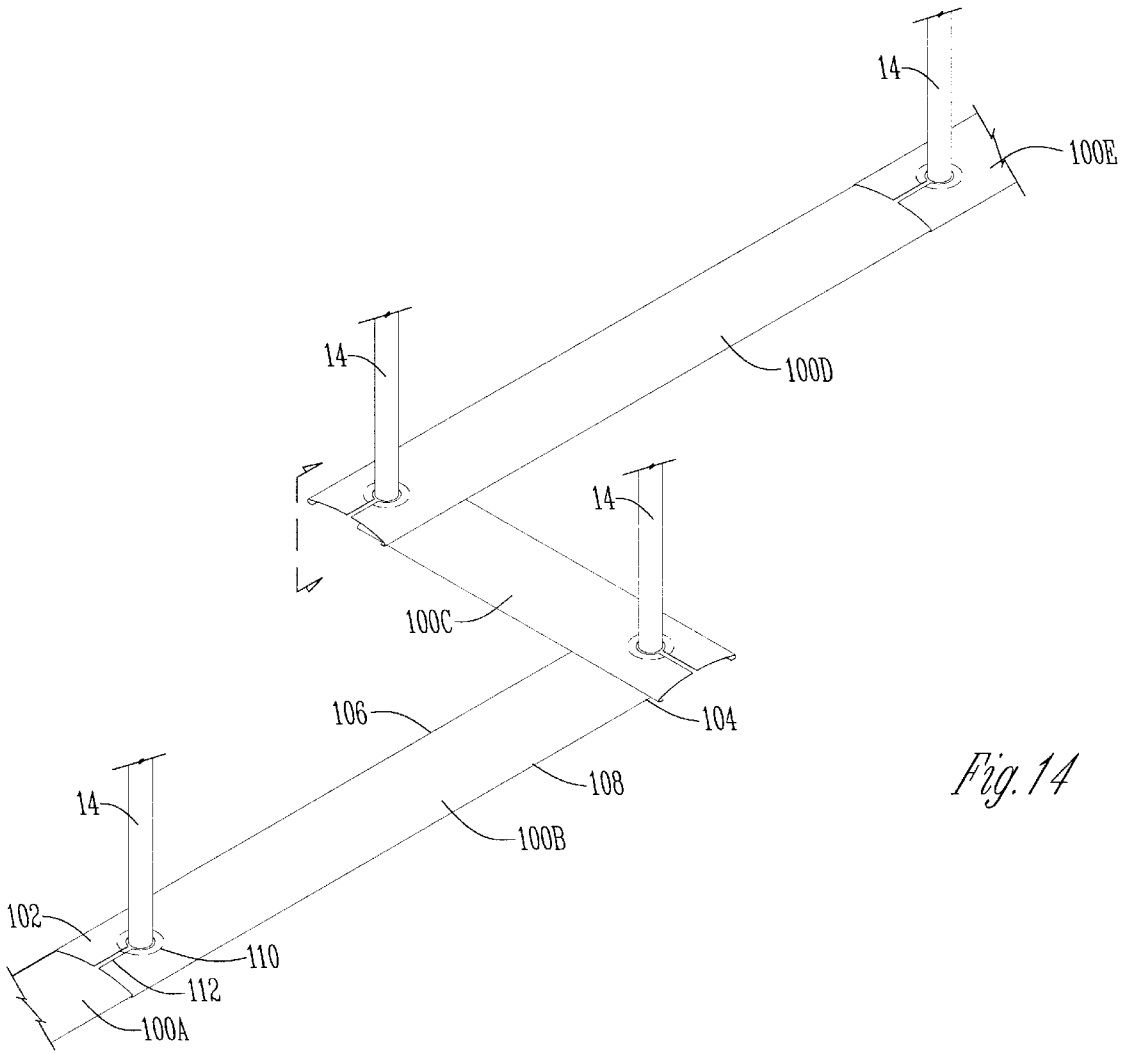
FIG. 14 is similar to FIG. 1 but illustrates another embodiment of a ground cover member according to the invention as installed relative to a fence.

FIGS. 14–28 illustrate a still further embodiment according to the invention. FIG. 14, similar to FIG. 1, shows a plurality of barriers 100 installed relative to a fence. Each member 100 is similar to barriers 10 previously described except as follows.

Each barrier 100 has a first end 102 and a second 104. Opposite side edges 106 and 108 include rolled under edges like edges 38 regarding barrier 10 previously described.

Each barrier 100 includes a pre-cut opening 110 and a slot 111 (e.g. approx. 2½" long) between the very outer edge of end 102 and opening 110. End 104 is solid and is simply squared off.

As can be seen in FIG. 14, barriers 100 are installed by bending one side or the other of an end 102 and inserting end 102 relative to a fence post 14 so that fence post 14 is within opening 110. End 104 of barrier 100 is preferably in abutment with the relevant post 14. Because end 104 is squared off, and because of the structure and material of barrier 100, with simple conventional tools, end 104 can be measured and cut to have that relationship between posts 14.

As seen in FIG. 14, succeeding barriers 100 are sequentially installed in that manner along fence line relative to posts 14. Overlapping ends 102 and 104 of succeeding barriers 100 cooperate to hold barriers 100 in alignment with the fence.

Figure 15:
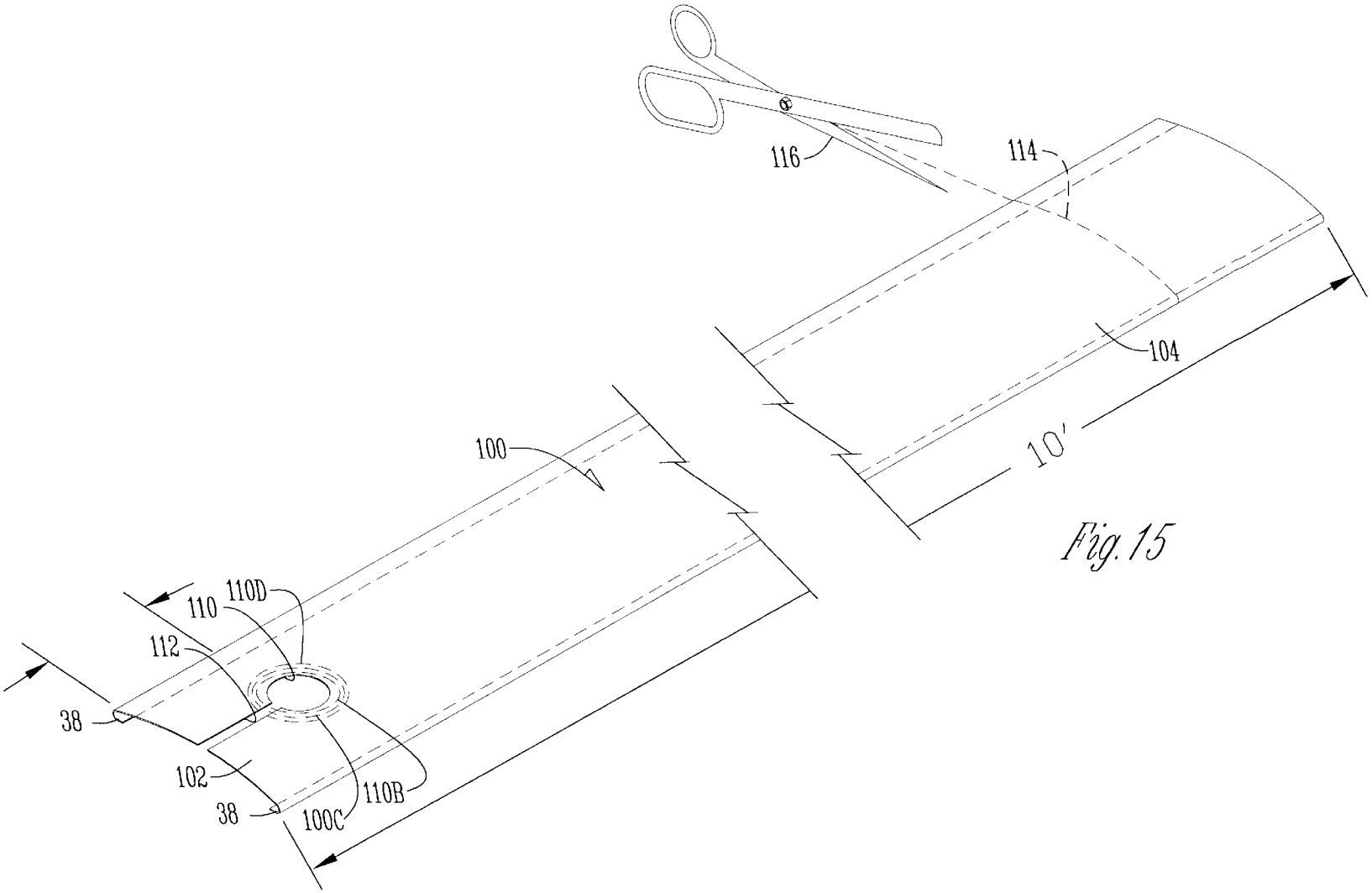
FIG. 15 is an enlarged perspective view of a single section of embodiment of the invention shown in FIG. 14.
Figure 16:
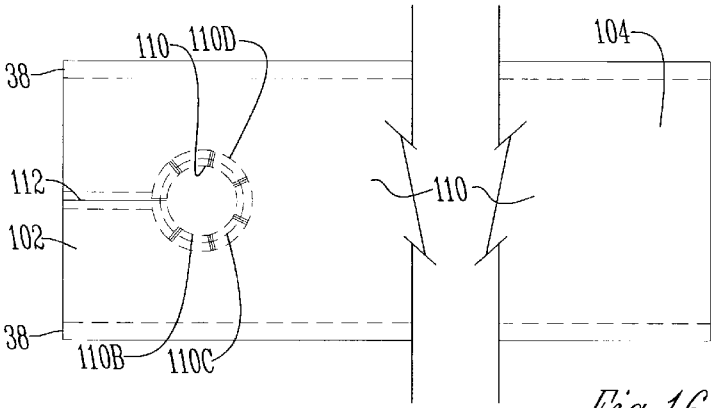
FIG. 16 is a still further enlarged top view of the embodiment of FIG. 15.

FIGS. 15 and 16 illustrate barrier 100 in more detail. Rolled under edges 38 in cooperation with the rest of barrier 100 define an open area underneath barrier 100. In the preferred embodiment, barriers 100 are made to uniform lengths. One style is 125" long. This length is picked because it represents usually the maximum distance between chain link fence posts. It is to be understood that many times fence posts 14 are not precisely spaced apart in ten foot intervals. Therefore, as indicated in FIG. 15, squared off end 104 can simply be cut to length on the spot for conventional tools such as scissors 116 so that barrier 100 can be essentially wedged in between a fence post 14 secured in opening 110 at end 102 of barrier 100, and end 104 abutting directly against the succeeding fence post 104.

Alternatively, for ease of handling, packaging, and transport, barrier 100 could be made of two pieces, each 67" long, for example, with one piece having the opening 110 at end 102. The other piece would have no openings and would simply have its end 102 snapped over end 104 of the first piece. This is possible because of the rolled under edges. Pieces 67" long would be easier for individuals to carry and transport in automobiles.

Opening 110 can be on the order of two inches in diameter. Slot 112 can be 0.25 inches in width. The distance between the very edge of end 102 and center of opening 110 can be four inches.

Similar to what is discussed relative to FIG. 10 previously, opening 110 can be pre-formed. Scoring or other methodology can be used to create break lines at 110*b*, 110*c*, 110*d*, for example, to provide the ability to easily expand opening 110 to fit different sized fence posts as needed.

Figure 17:
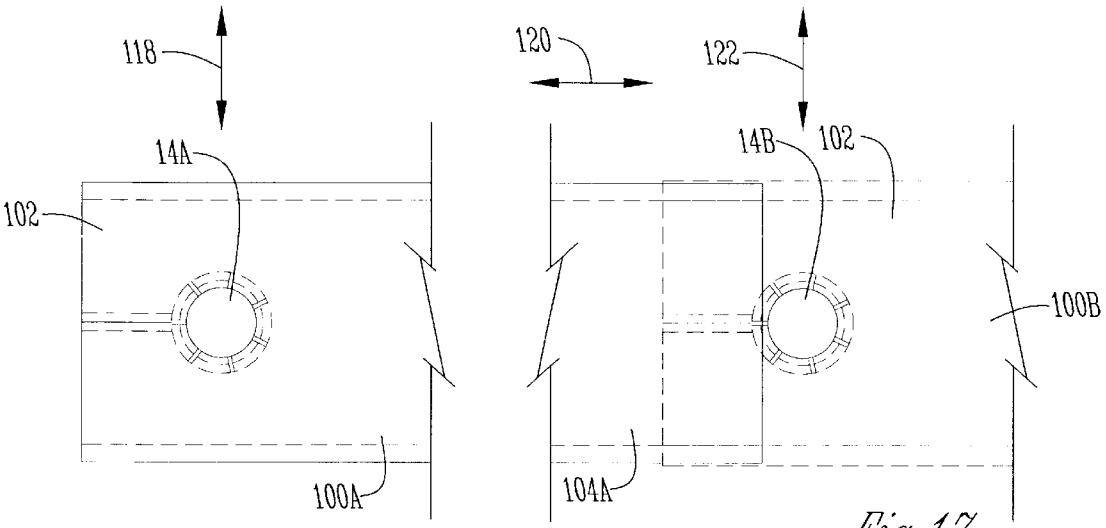
FIG. 17 is a reduced in size top view of the embodiment of FIG. 15 showing it installed relative two fence posts.

FIG. 17 illustrates how barrier 100 can be wedged or placed between succeeding fence posts 14*a* and 14*b*. As indicated at arrow 118, end 102 of barrier 100 secured around post 14*a*, lateral movement of barrier 100 is prevented. Once end 104 of barrier 100 is appropriately trimmed to size, if needed, and wedged against post 14*b*, longitudinal movement of barrier 100 is prevented (see arrow 120). The wedging action also deters lateral movement of end 104 of barrier 100*a* (see arrow 122). This relationship, in combination with barrier 100 being forced under the chain link fence between posts 14*a* and 14*b*, which would prevent raising of barrier 100, generally serves to hold it in position. Rolled under edges 38, at opposite edges of barrier 100, push upwardly against any force down in the middle of barrier 100 by the chain link fence, also helping to keep barrier 100 in place.

Still further, the succeeding barrier 100*b* in FIG. 17, would overlap over and clamp around end 104 of barrier 100*a*. Because end 102 of barrier 100*b* is also secured around posts 14*b*, this serves to further prevent end 104 of barrier 100*a* from moving laterally.

Figure 18:
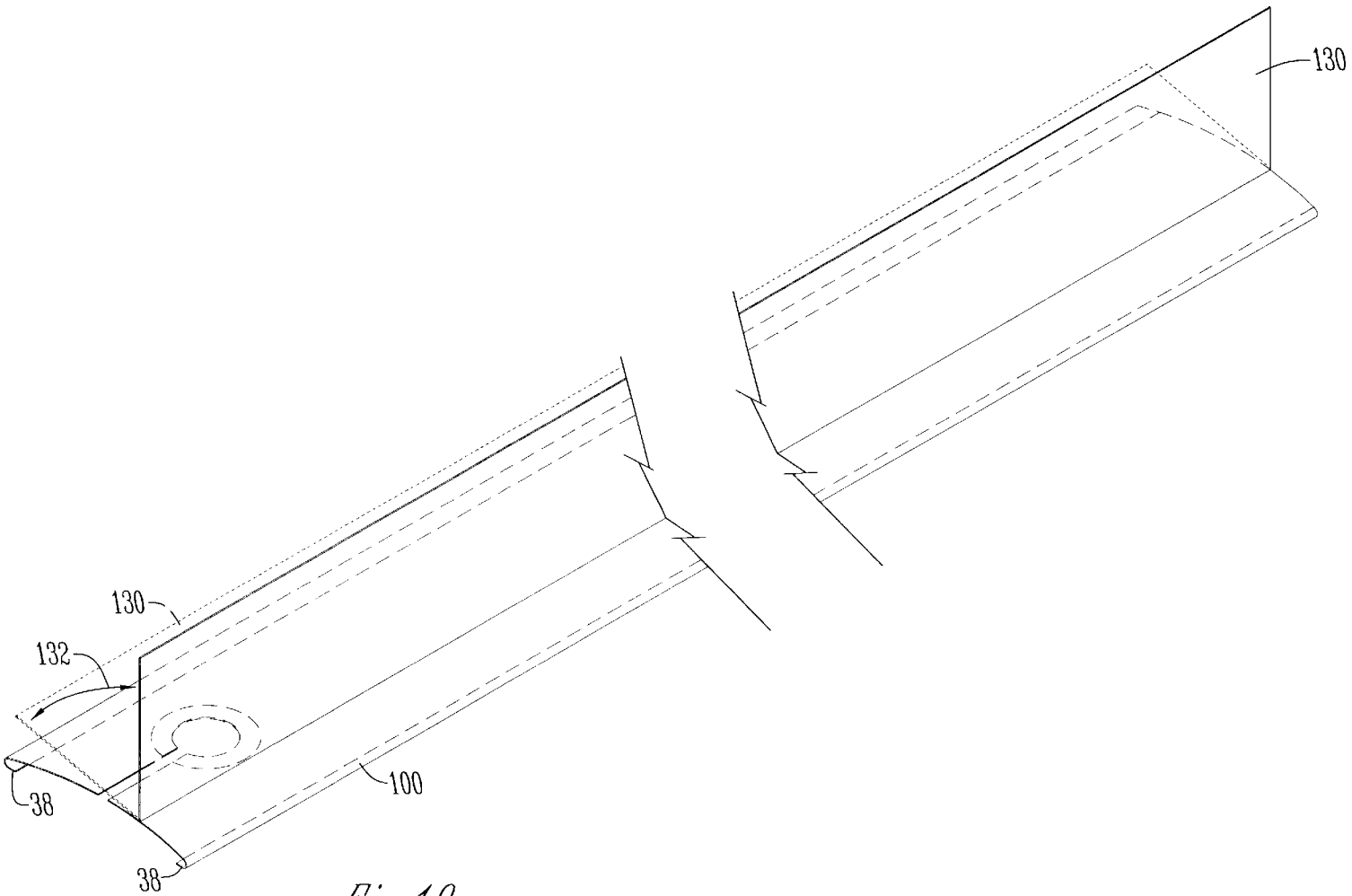
FIG. 18 is similar to FIG. 15 which shows an optional vertical riser on the embodiment.

FIG. 18 depicts an optional feature of barrier 100. A vertical riser 130, similar to vertical riser 20 described previously, could be molded into barrier 100 along at least substantial portion of its length. Riser 130 could be scored on the far side of FIG. 18 at its intersection with riser 100, and as indicated by arrow 132, fold down against the top of barrier 100. This can be advantageous regarding storage or shipping, to reduce the volume of space taken up by advice.

As previously described, vertical riser 130 can sometimes be useful in securing the barrier to fences or structures. As has also been discussed, plastic material can easily be cut away. Portions of vertical riser 130 could be cut away and portions left. One side or the other of barrier 100 could be cut away leaving riser 130 and the remaining side of barrier 100. This can be quickly accomplished with a utility knife or scissors or the like. A simple straight edge could be used also.

In any event, the cooperation of rolled under edges or edge 38, with the barrier 100 or the portion of which remains, and/or vertical riser 130, allow for installation to the fence and coverage of the ground thereby.

Figure 19:
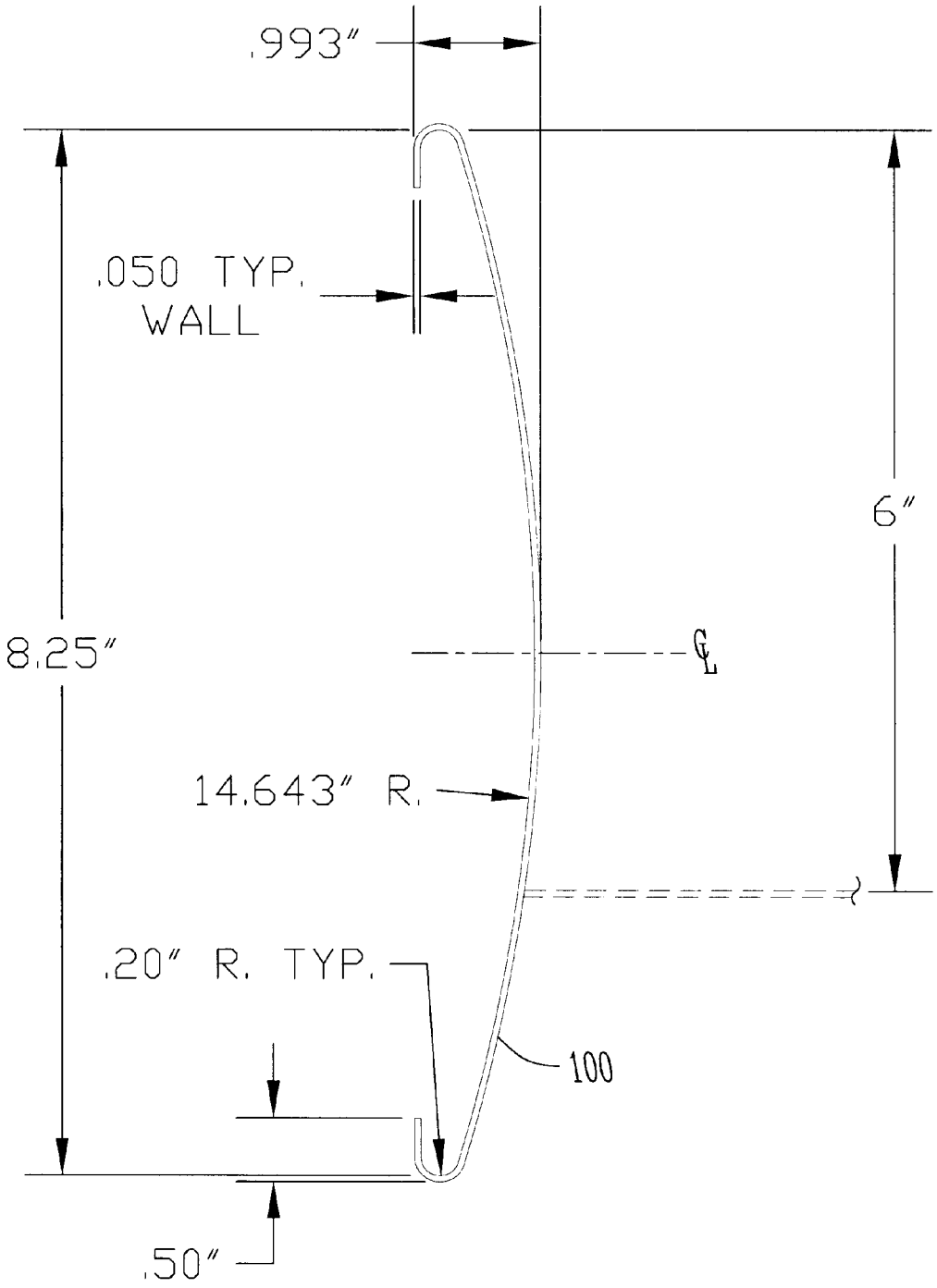
FIG. 19 is an enlarged end view of the embodiment of FIG. 15.

FIG. 19 gives additional dimensions regarding barrier 100. Particularly note that during molding, a radius of 14.643 inches for most of the width of barrier 100 is designed into barrier 100.

Figure 20:
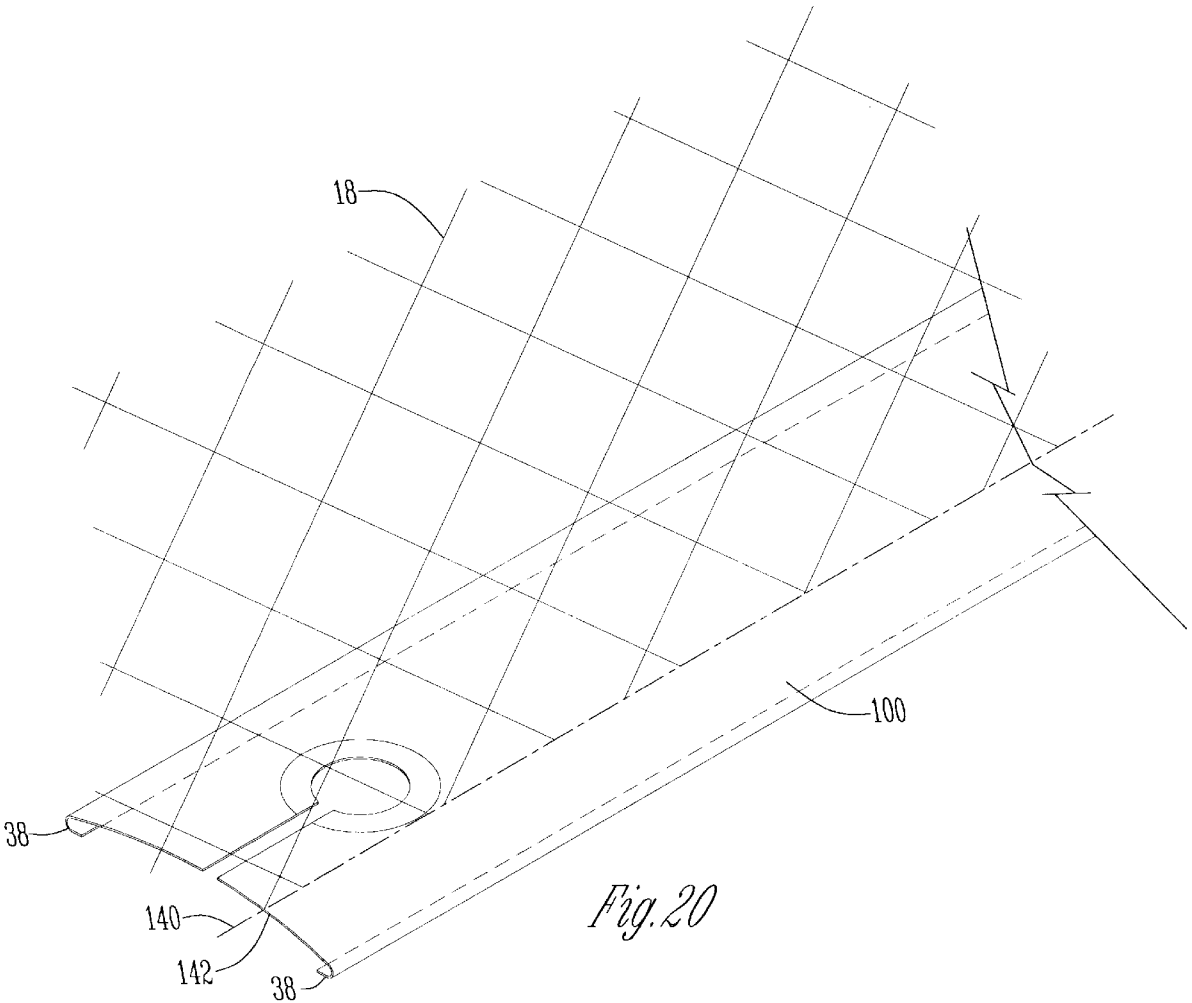
FIG. 20 is an enlarged perspective of the embodiment of FIG. 15 relative to the bottom of a chain link fence.

FIG. 20 illustrates how barrier 100 can function together with chain link fence 18. Barrier 100 is made up of somewhat rigid yet somewhat flexible plastic.

As previously discussed and as illustrated in the drawings, barrier 100 is molded (for example, through a die) with a pre-formed radius of curvature for the general barrier 100 and specific radius of curvature for the rolled under edges. Barrier 100 can be made of recycled plastics. The shape essentially has somewhat of a memory. It fights to go back to its original shape if forces push down on that radius. The material to barrier 100 is HDPE plastic. In one embodiment, its weight per foot is 0.172. Further description of material that can be used with barrier 100 is set forth below.

The following are the specifications of the Exxon Wide-Spec. HDPE:

| | | |
|---|---|---|
| Melt Flow: | .25 g/10 min. | (Average) |
| Density: | .951 | (Average) |

The following are the properties of the Exxon HDPE AA55-003 when prime:

| | |
|---|---|
| Flexural Modulus: | 151,000 psi |
| Tensile @ Yield: | 4030 psi |
| Elongation @ Break: | 602.0% |
| Durometer | 69 Shore D |
| Vicat Softening: | 258 Fahrenheit |

FIG. 20 illustrates that the flexibility of member 100 combined with rolled under edges 38 allows barrier 100 to be pressed down and slid fence 18 in position between posts 14 in the manner previously described. Because rolled under edges 38 urge the middle part of barrier 100 normally upward, and there is an open unobstructed space underneath barrier 100 between rolled under edges 38, fence 18 would push down on the center of barrier 100 and thus force would be placed downward relative to rolled under edges 38. Barrier 100 would assume the shape indicated in FIG. 20, with the portion directly under fence 18 being pushed downwardly and innerwardly. Rolled under edges 38 and the rest of barrier 100 would resist and react against any further forces downward and thus help keep barrier 100 in position between posts 14, and help to keep rolled under edges 38 in contact with the ground to provide a good barrier and resist wind or debris from getting under the edges.

Figure 21:
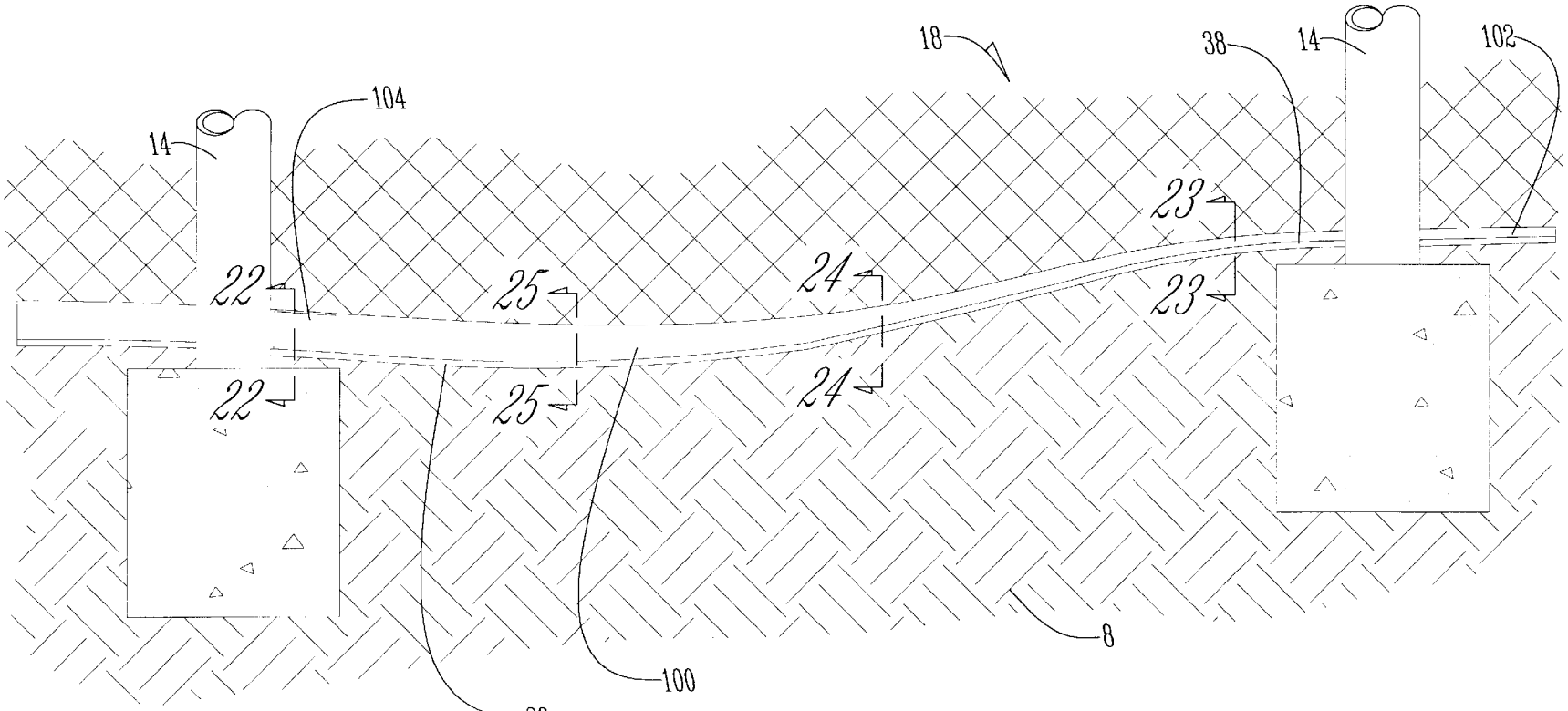
FIG. 21 is a side elevational view of the embodiment of FIG. 15 relative to a bottom of a chain link fence illustrating how the embodiment can block gaps between the bottom of a chain link fence and undulating ground.

FIG. 21 is similar to FIG. 6 except for the following. It illustrates a barrier 100 between two posts 14 (installed as previously described). It is also intended to illustrate that the surface of the ground between posts 14 is not flat. In this example the ground not only lowers between right fence post 14 and left fence post 14, but undulates downwardly.

Figure 23:
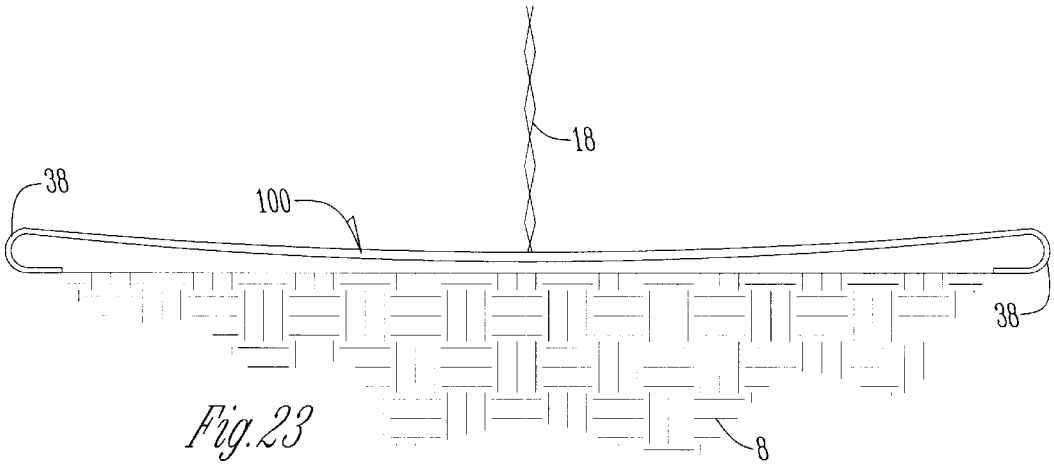
FIG. 23 is an enlarged sectional view taken along line 23—23 of FIG. 21.

Normally, relative to essentially flat ground, side elevational view of barrier 100 would appear similar to that shown on the right side of FIG. 21. Fence 18 would push down on the middle of barrier 100 and opposite side edges 38 would sit on the ground. FIG. 23 shows this in cross section.

In the situation of FIG. 21, however, it can occur that fence 18, when installed, would leave a gap between ground surface and the bottom of fence 18, as shown going to the left in FIG. 21. If the gap between barrier 100 and the bottom of fence 18 is desired to be closed, one possible way of doing so is as follows.

Figure 24:
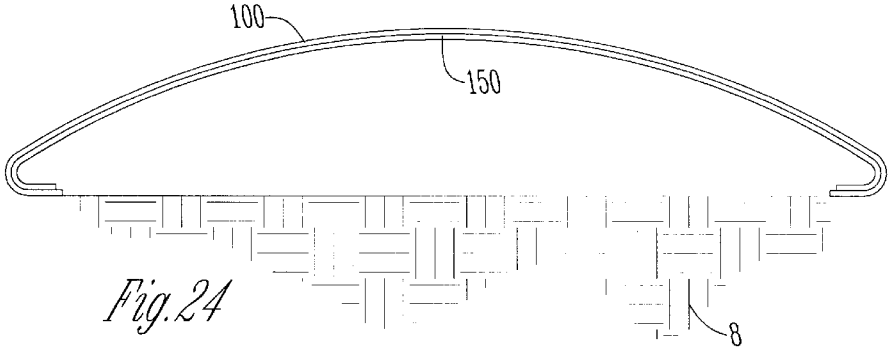
FIG. 24 is an enlarged sectional view taken along line 24—24 of FIG. 21.

An insert piece 150, could be placed inside barrier 100 and locked in between rolled under edges 38. Piece 150 could be shaped in a manner to urge the top of barrier 100 upwardly. As shown in FIG. 24, such a piece 150 appropriately shaped and appropriately inserted to exert the proper force, could owe barrier 100 upwardly at that position so that its center raises up to the bottom of fence 18.

Figure 25:
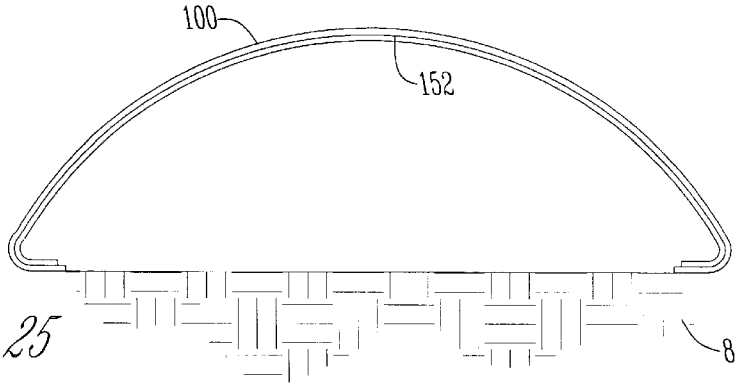
FIG. 25 is an enlarged sectional view taken along line 25—25 of FIG. 21.

FIG. 25 shows that if further raising of barrier 100 at that point is needed to fill in any such gap, a different piece 152, shaped differently or can figure differently, so that it pushes the center of barrier 100 even further up, could be used to fill in the gap.

Pieces such as 150 and 152 could be of a wide variety of materials and configurations. Preferably they could be made from the trimmings or un-used material from barriers 100 themselves. A worker could cut out a piece 150 and simply a rectangular shape such that it creates an arch of the height needed to raise the center of barrier 100 sufficiently to fill in a gap.

Figure 22:
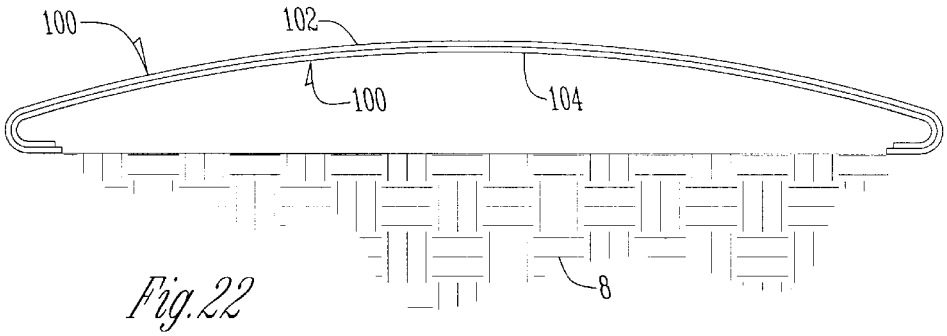
FIG. 22 is an enlarged sectional view taken along line 22—22 of FIG. 21.

FIG. 22 shows in cross section the overlap of adjacent edges of barriers 100. The flexibility of barrier 100 allows one to be placed over the next. There identical cross sectional shapes allows them to essentially be snapped over one another and locked in position.

Figure 26:
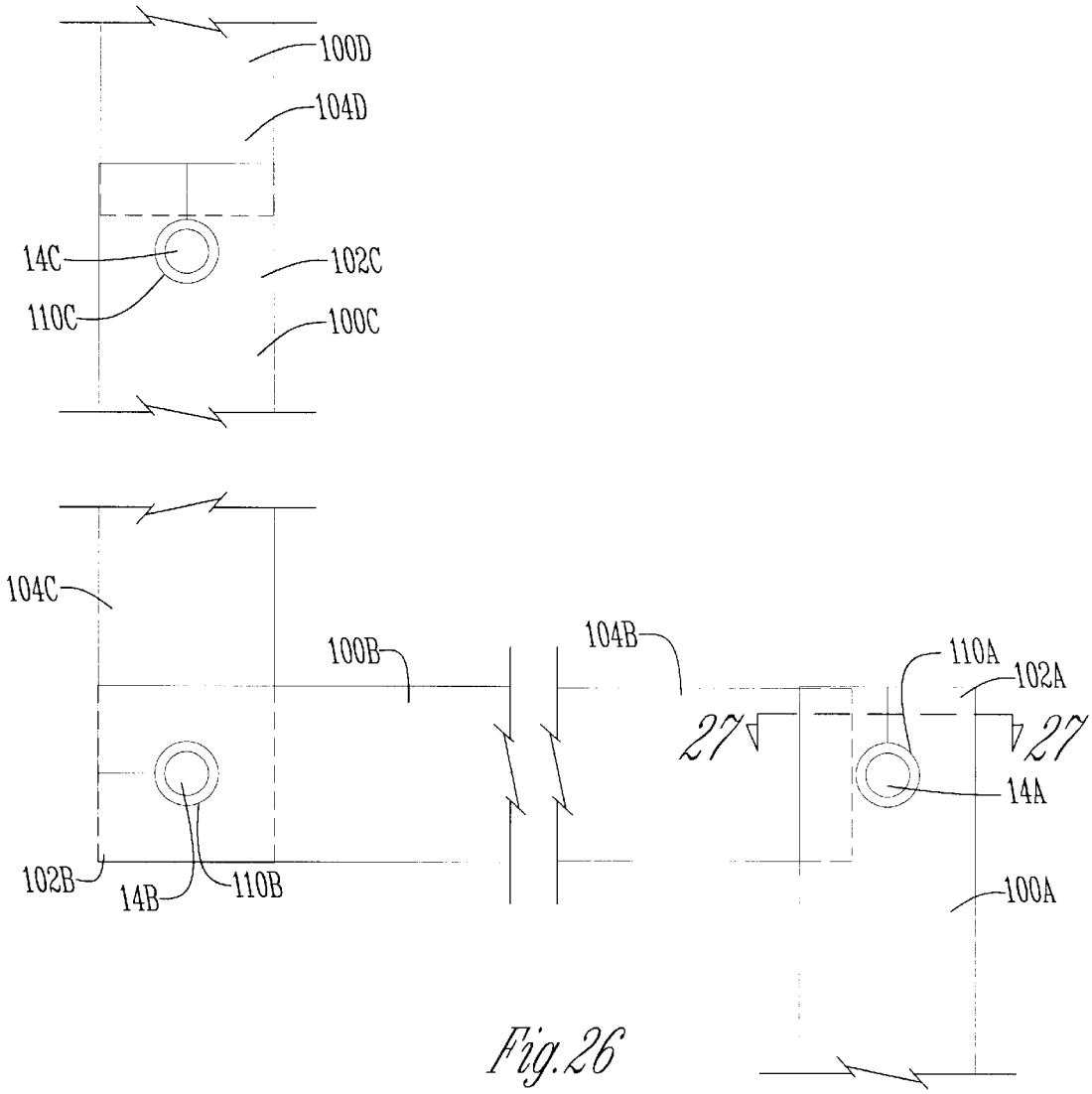
FIG. 26 is a top view showing in more detail the interconnection of multi devices according to FIG. 15 installed relative to fence posts.

FIG. 26 illustrates one method of overlapping adjacent edges of barrier 100. Barrier 100*a* has an end 102*a* with an opening 110*a* that can surround a post 14. The next barrier, 100*b*, would be installed by surrounding opening 110*b* at end 112*b* around succeeding post 14 and then end 104*b* of barrier 100*b* would then be fit so that either by its original length abuts against post 14*a*, or is trimmed or cut to that length. End 104*b* would be slid underneath end 102*a* of barrier 100*a*, as shown in FIG. 26. Similarly, end 102*c* of barrier 100*c* would be placed so that opening 110*c* would surround post 14*c*. Opposite end 104*c* would be appropriate size so that when laid flat against the ground, end 104*c* would abut against and wedge against post 14*b* but would be placed underneath end 102*b* of barrier 100*b*.

Figure 27:
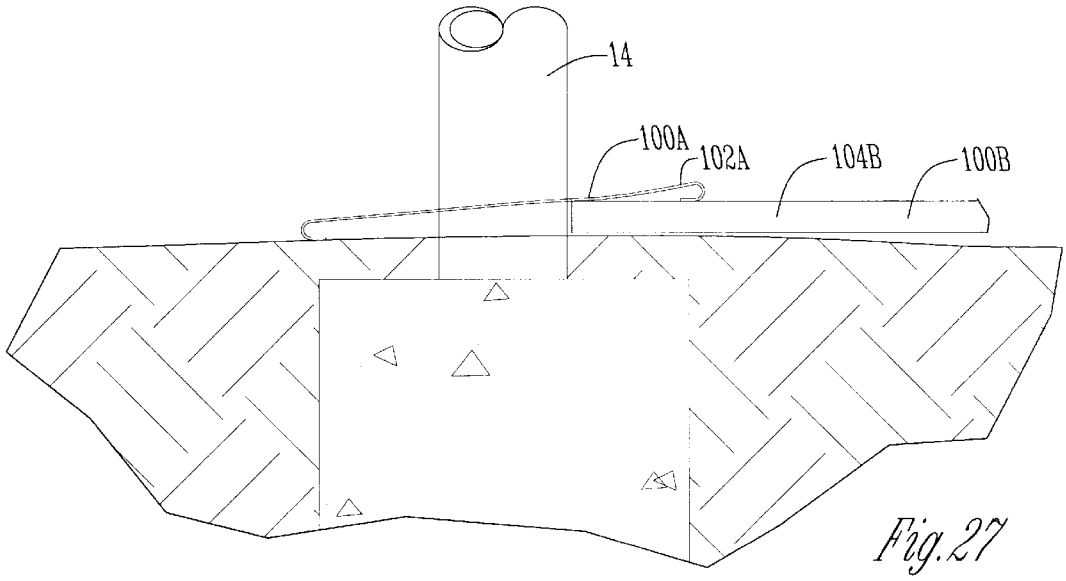
FIG. 27 is an enlarged view of the overlap of devices according to FIG. 15 at a fence post when the connection is perpendicular.
Figure 28:
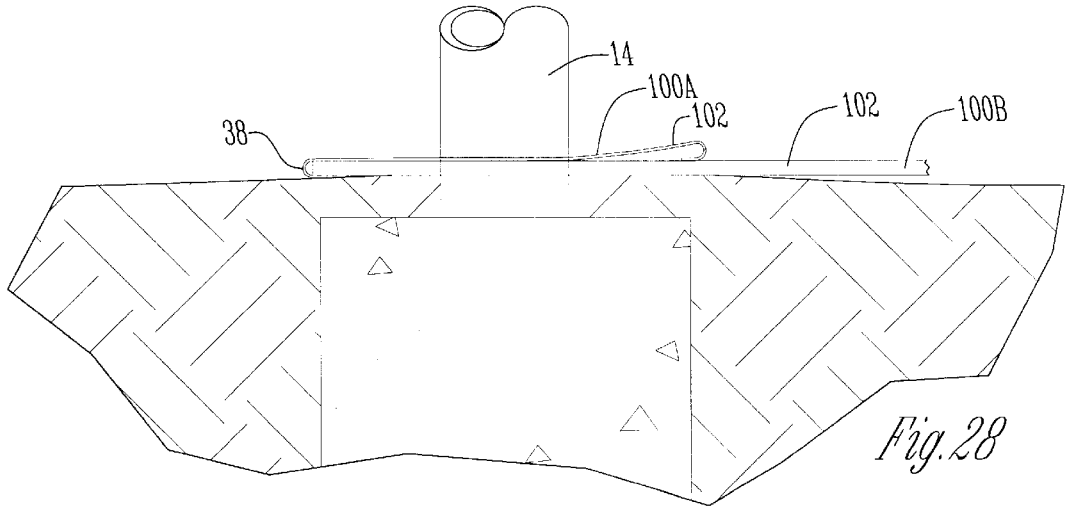
FIG. 28 is an alternative overlap similar to FIG. 27.

FIG. 27 illustrates how such an installation process such as shown in FIG. 26 allows one end 102 of a barrier 100*a* to at least partially overlap and lay on top of end 104*b* of barrier 100*b* to insist in keeping it positioned. An alternative is shown at FIG. 28 where two ends 102 for different barriers 100*a* and 100*b* overlap over the same posts 14. In that case, rolled under edge 38 of one end 102 could actually snap over the end 102 of the other barrier 100.

As can been seen from the drawings and as described, the pre-formed hole 110 in barriers 110 can be punched after barrier 110 is produced. Slot 112 can also be punched. This arrangement allows barrier 100 to be manipulated by raising one side of end 102 of barrier 100 to allow passage of fence post through the location of slot 112 into opening 110. The flap would be released and returned to the shape shown in FIG. 15.

To further secure end 102 of barriers 100, a short section (e.g. 2½") of barrier 100 could be cut off of end 104 or from another piece and quickly snapped over end 102 of barrier 100 to cover slot 112. This would prevent flaps on either side of 112 from lifting up for any reason.

It can therefore be seen that the embodiment shown in FIGS. 14–28 provide a convenient and easy way of installing a barrier underneath fences. Essentially uniform pieces (barriers 100) could be produced economically by conventional plastic production. The profile serves to provide resilience to assist in holding barrier 100 in place and sealing against the ground. Pre-punched openings 110 coordinate with slots 112 allow positioning of the barrier 100 around fence posts to assist in keeping them in place. This essentially one-piece system is user friendly, does not involve the use of specialized or numerous tools, does not require additional and hard to handle equipment or components such as tie wraps, does not require nailing or gluing or caulking, and does not require use of specialized templates or customization procedures.

As described previously, a purchaser can purchase the correct number barriers 100 and the inherent nature of barriers 100 allows them to be easily cut to size using simple tools and procedures and with minor customization fit various size post holes and distances between posts. Scrap pieces from barrier 100 itself can be used to cover the flaps of ends 102 if desired or to create bridges or inserts to raise the cross-sectional profile of barrier 100 as described elsewhere.

What is claimed is:

1. A barrier apparatus for covering and deterring vegetation growth at and near fence bottoms, foundations, or other structures comprising:

(a) an elongated member made of a relatively thin, flexible and resilient material having first and second opposite ends and opposite sides, and an intermediate portion between said opposite sides having a width, a top and a bottom, the elongated member includes a pre-formed opening near said first end and further comprising a pre-formed slot between the perimeter of the elongated member and the pre-formed opening;

(b) each opposite side having an outer edge comprising a rolled under edge; the rolled under edge including a section with a radius, the section having a proximal margin integral with the intermediate portion and terminating in a distal free margin positioned slightly over 180 degrees from the proximal margin, the distal margin spaced from the bottom of the intermediate portion but facing substantially towards the opposite side of the member; the rolled under edges and intermediate portion defining an open space underneath the bottom of the intermediate portion; the distal margins of the rolled under edges adapted to snap-fit in an overlapping manner over a similar profile.

2. The barrier of claim 1 wherein the elongated member is made of plastic.

3. The barrier of claim 1 wherein the elongated member is approximately ten feet long.

4. The barrier of claim 1 wherein the second end is devoid of any pre-formed openings.

5. The barrier of claim 1 wherein the slot is between the outer edge of the first end and the preformed opening.

6. A method of covering ground or vegetation under a fence that is mounted on a plurality of fence posts comprising:

(a) manufacturing a plurality of elongated members each having first and second opposite ends and opposite sides, with each opposite side comprising a rolled under edge;

(b) placing an elongated member under the fence on top of the ground;

(c) placing a succeeding elongated member under the fence;

(d) overlapping a first end of a succeeding elongated member next to the second end of the elongated member by snapping the rolled under edges of one of the members over the end of the other member;

(e) continuing with still further elongated members if needed.

7. The method of claim 6 further comprising pre-forming an opening in the first end of the elongated members and forming a slot from the perimeter of the elongated member to the opening, then manipulating the elongated member to position the opening around a first fence post, placing the remainder of the elongated member under the fence.

8. The method of claim 7 further comprising, measuring the distance between first and second fence posts and cutting the second end of the elongated member so that it approximately. abuts the second fence post when the opening of the first end of the elongated member is installed around the first fence post.

9. The method of claim 8 further comprising, placing the opening of another elongated member around the second fence post, measuring the distance to a third fence post and cutting, if needed, the another elongated member to fit between the second and third fence posts.

10. The method of claim 9 further comprising manipulating the first end of the another elongated member to cause its rolled under edges to snap over the opposite edges of the second end of the elongated member.

11. The method of claim 9 further comprising overlapping adjacent ends of elongated members.

12. The method of claim 6 further comprising placing an arching member between opposite sides of an elongated member to raise the vertical height of the middle of the elongated member at and around the position of the arch.

13. The method of claim 12 wherein the arching member comprises a piece placed underneath the elongated member and held in place between said rolled under edges.

14. The method of claim 12 wherein the arching member is fabricated from trimmings of an elongated member.

15. A method of covering ground or vegetation under a fence that is mounted on a plurality of fence posts comprising:

(f) manufacturing a plurality of elongated members each having first and second opposite ends and opposite sides, with each opposite side comprising a rolled under edge;

(g) placing an elongated member under the fence;

(h) placing a succeeding elongated member under the fence;

(i) overlapping a first end of a succeeding elongated member next to the second end of the elongated member;

(j) continuing with still further elongated members if needed (k) further comprising placing an arching member between opposite sides of an elongated member to raise the vertical height of the middle of the elongated member at and around the position of the arch, wherein the arching member is fabricated from trimmings of an elongated member.

* * * * *